US007066738B2

(12) United States Patent
Maegawa et al.

(10) Patent No.: US 7,066,738 B2
(45) Date of Patent: Jun. 27, 2006

(54) OUTLET SOCKET

(75) Inventors: Akihito Maegawa, Yokkaichi (JP); Shinyu Nagashima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/114,264

(22) Filed: Apr. 25, 2005

(65) Prior Publication Data

US 2005/0239332 A1 Oct. 27, 2005

(30) Foreign Application Priority Data

Apr. 26, 2004 (JP) ..... 2004-130054

(51) Int. Cl.
*H01R 33/00* (2006.01)
*H01R 13/52* (2006.01)

(52) U.S. Cl. ..... 439/35; 439/519

(58) Field of Classification Search ..... 439/35, 439/519, 76.2, 106, 131, 275, 521, 206, 587; 174/48, 50; 307/10.1
See application file for complete search history.

(56) References Cited

U.S. PATENT DOCUMENTS 5,800,188 A * 9/1998 Barber et al. ..... 439/142
6,080,014 A * 6/2000 Steiler ..... 439/574
6,273,729 B1 * 8/2001 Kelly ..... 439/36
2004/0083658 A1 * 5/2004 Laukuf et al. ..... 52/36.4

FOREIGN PATENT DOCUMENTS

JP 7-161411 6/1995
JP 8-154310 6/1996
JP 10-199611 7/1998

* cited by examiner

*Primary Examiner*—Chandrika Prasad
(74) *Attorney, Agent, or Firm*—Gerald E. Hespos; Anthony J. Casella

(57) ABSTRACT

A socket body (20) including a plug socket terminal accommodation chamber (23) and a ground terminal accommodation chamber (24) below the plug socket terminal accommodation chamber (23). The ground terminal accommodation chamber (24) has an aperture (30) formed along a direction substantially orthogonal to an insertion direction of a mating plug and a vertical direction and the ground terminal (31) is accommodated through the aperture (30). A downwardly open draining hole (29) is formed on a periphery of the plug socket terminal accommodation chamber (23). A rib (36) is formed on a peripheral surface so that a distance between the rib (36) and the aperture (30) is shorter than a distance between the rib (36) and the draining hole (29).

10 Claims, 13 Drawing Sheets

OUTLET SOCKET

BACKGROUND OF THE INVENTION

1. Field of the Invention

The present invention relates to an outlet socket.

2. Description of the Related Art

A plug socket having a mode of exposing a receptacle to the outside of a vehicle is frequently mounted on a vehicle such as a pick-up truck to supply electricity to a vehicle to be towed or use electric apparatuses outside the vehicle. Japanese Patent Application Laid-Open No.8-154310 and FIG. 13 herein show an outlet socket for use in this kind of plug socket. With reference to FIG. 13, the plug socket includes a socket body 1, a plug socket terminal accommodation chamber 2 accommodating a plug socket terminal, and a ground terminal accommodation chamber 3 accommodating a ground terminal. The plug socket terminal accommodation chamber 2 and the ground terminal accommodation chamber 3 are arranged vertically in conformity to the configuration of a mating plug. One sidewall of the ground terminal accommodation chamber 3 is removed to form an aperture 4 because the ground terminal is mounted sideways on the ground terminal accommodation chamber 3.

The plug socket of FIG. 13 is covered with a cover. However, there is a possibility that water will penetrate into the plug socket terminal accommodation chamber 2 from the outside. Thus, a downwardly open draining hole 5 may be formed on the periphery of the plug socket terminal accommodation chamber 2. However, the aperture 4 is formed on the ground terminal accommodation chamber 3, and there is a fear that water discharged from the draining hole 5 will flow along the peripheral surface of the socket body 1 and penetrate into the ground terminal accommodation chamber 3 via the aperture 4, thereby causing the ground terminal and the plug socket terminal to be short-circuited.

The invention has been completed in view of the above-described situation. Therefore it is an object of the present invention to make it difficult for a short circuit to occur.

SUMMARY OF THE INVENTION

The invention relates to an outlet socket for use in a vehicle. The outlet socket includes a socket body with a plug socket terminal accommodation chamber for accommodating a plug socket terminal. The socket body also has a ground terminal accommodation chamber disposed below the plug socket terminal accommodation chamber and configured to accommodate a ground terminal. The ground terminal accommodation chamber has an aperture formed along a direction substantially orthogonal to an insertion direction of a mating plug and orthogonal to a vertical direction. The ground terminal is accommodated through the aperture. A downwardly open draining hole is formed on a periphery of the plug socket terminal accommodation chamber. A step is formed on a peripheral surface so that a distance between the step and the aperture is shorter than a distance between the step and the draining hole.

Water that penetrates into the plug socket terminal accommodation chamber from the outside is discharged from the draining hole. As described above, there is a fear that the discharged water will flow along the peripheral surface of the socket body and penetrate into the ground terminal accommodation chamber through the aperture. However the step is formed on the peripheral surface so that the distance between the step and the aperture is shorter than the distance between the step and the draining hole. Thus it is possible to increase the creeping distance from the draining hole to the ground terminal accommodation chamber by the distance of the peripheral surface of the step. Accordingly water is unlikely to penetrate into the ground terminal accommodation chamber, and a short-circuit between the plug socket terminal and the ground terminal is unlikely.

The socket body preferably is mounted on a member, and the member has a wall that plugs the aperture when the socket body is mounted on the member. Thus, water is unlikely to penetrate the ground terminal accommodation chamber.

The wall preferably slides in contact with the step when the socket body is mounted on the member, thereby guiding a mounting operation.

DETAILED DESCRIPTION OF THE PREFERRED EMBODIMENTS

Figure 1:
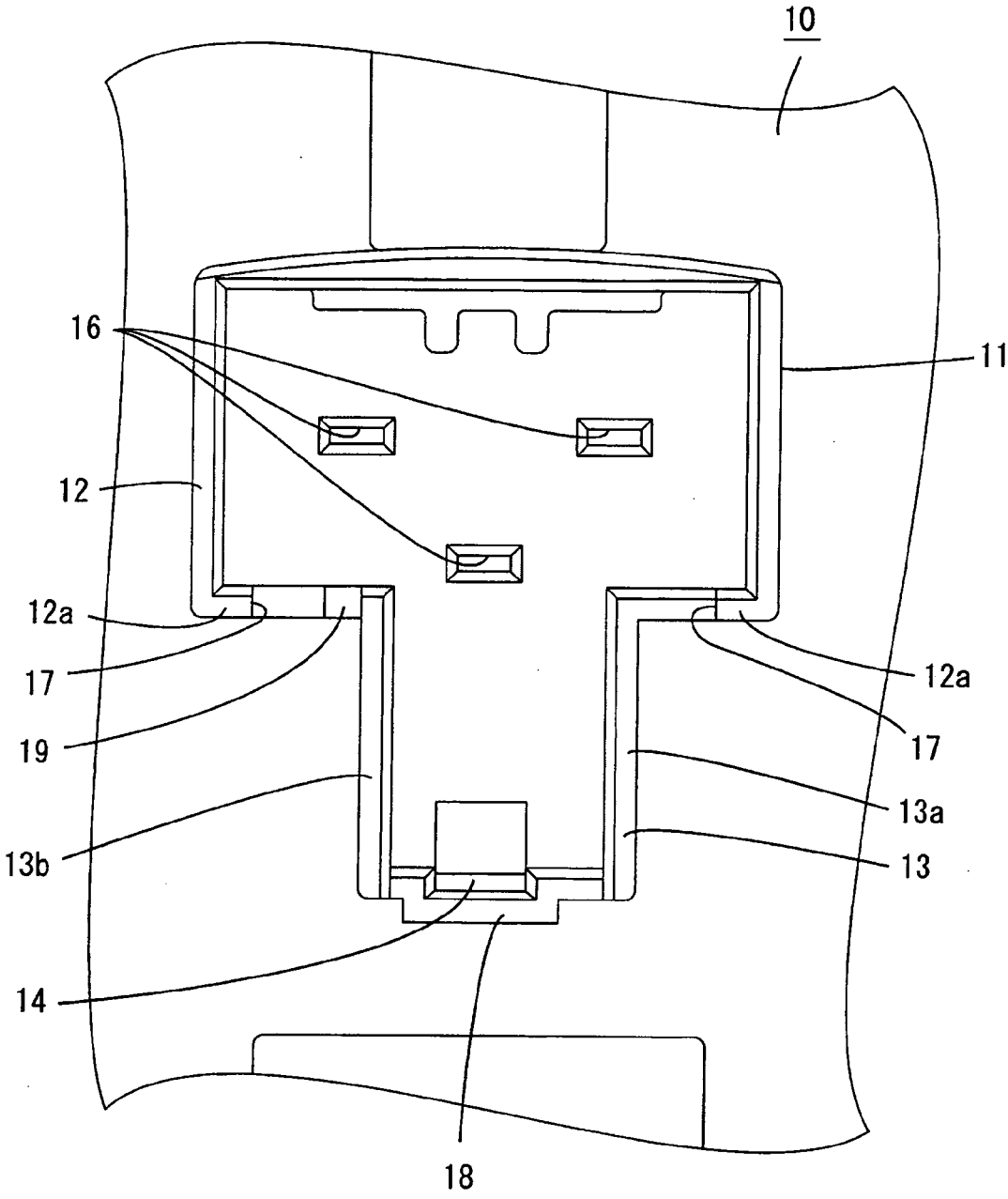
FIG. 1 is an enlarged front view showing a socket body according to an embodiment of the present invention.
Figure 2:
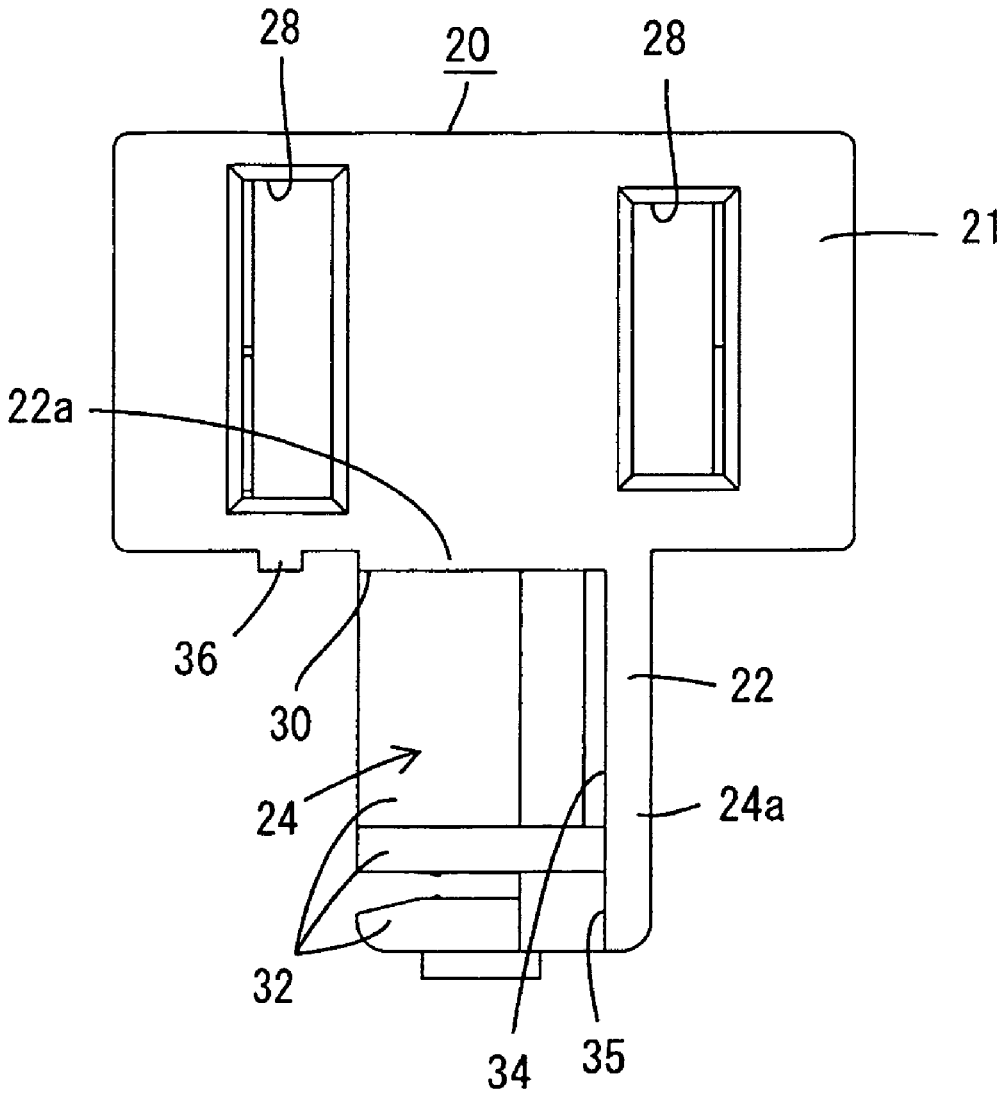
FIG. 2 is a front view of the socket body.
Figure 3:
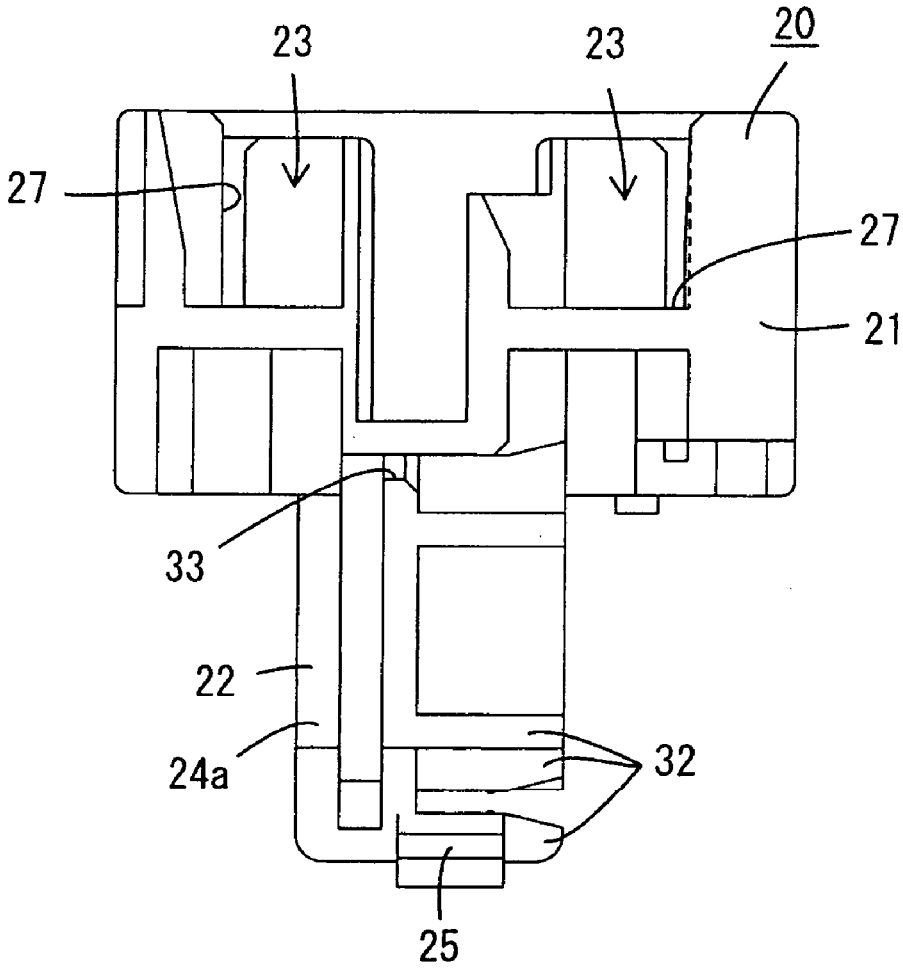
FIG. 3 is a rear view of the socket body.
Figure 4:
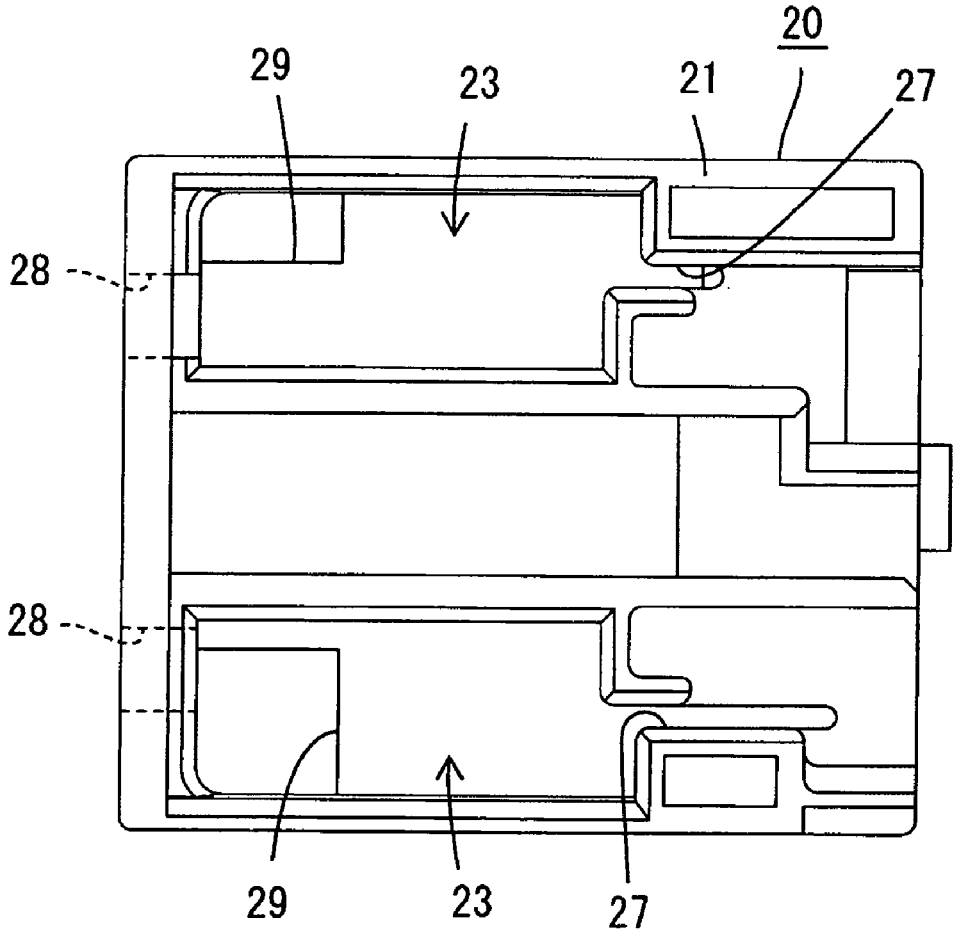
FIG. 4 is a plan view of the socket body.
Figure 6:
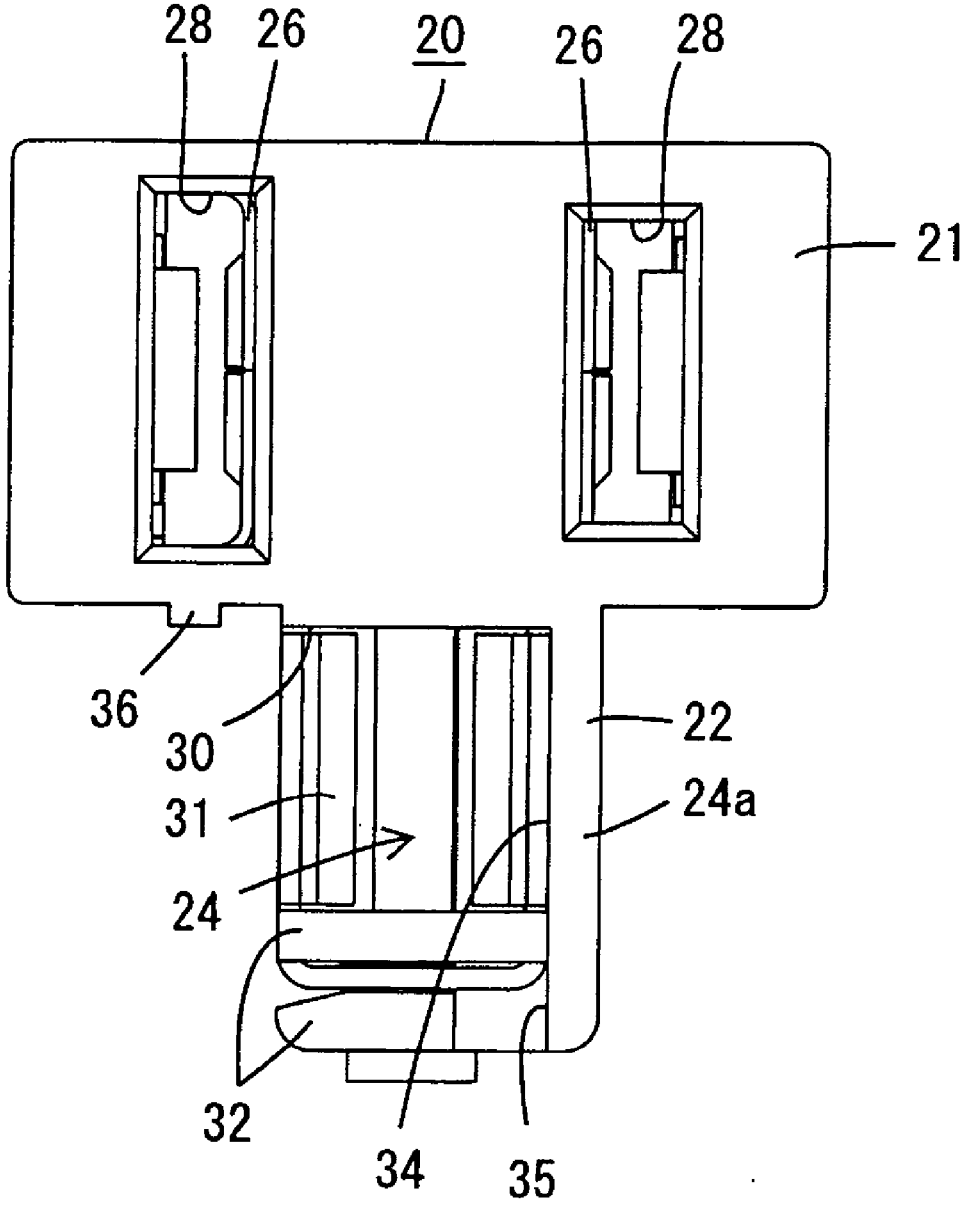
FIG. 6 is a front view of the socket body on which terminals are mounted.
Figure 7:
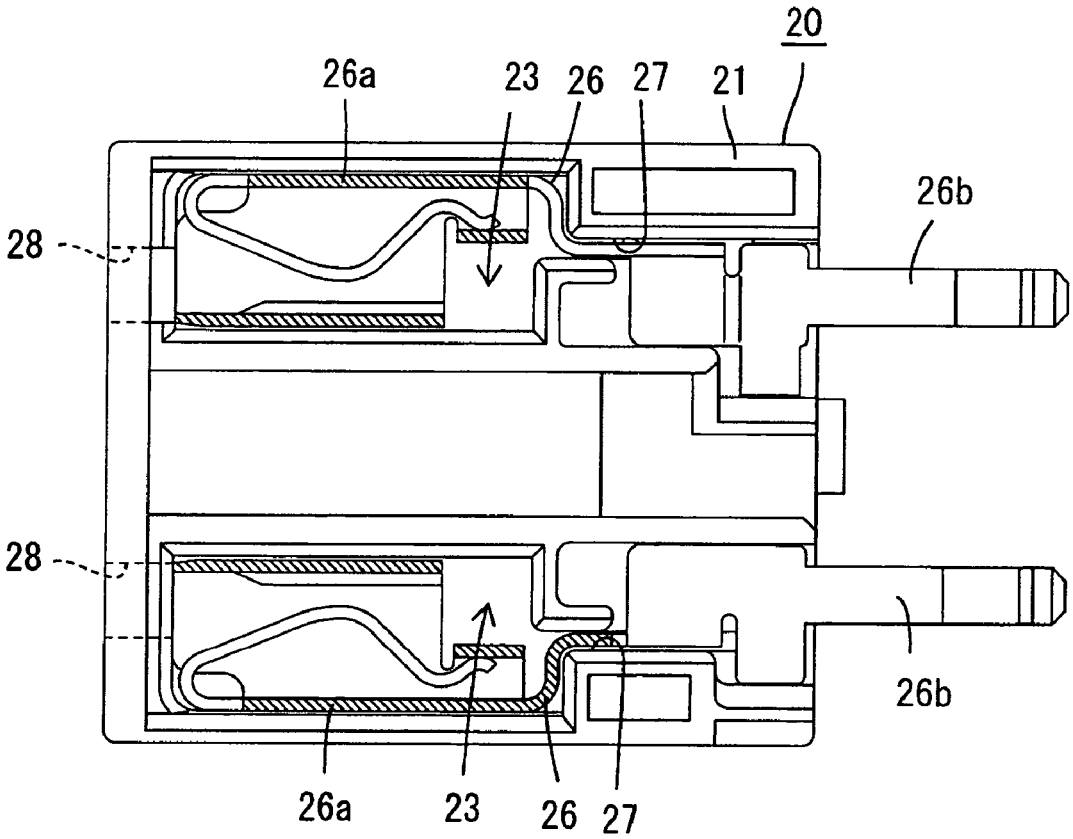
FIG. 7 is a plan view of the socket body on which the terminals are mounted.
Figure 8:
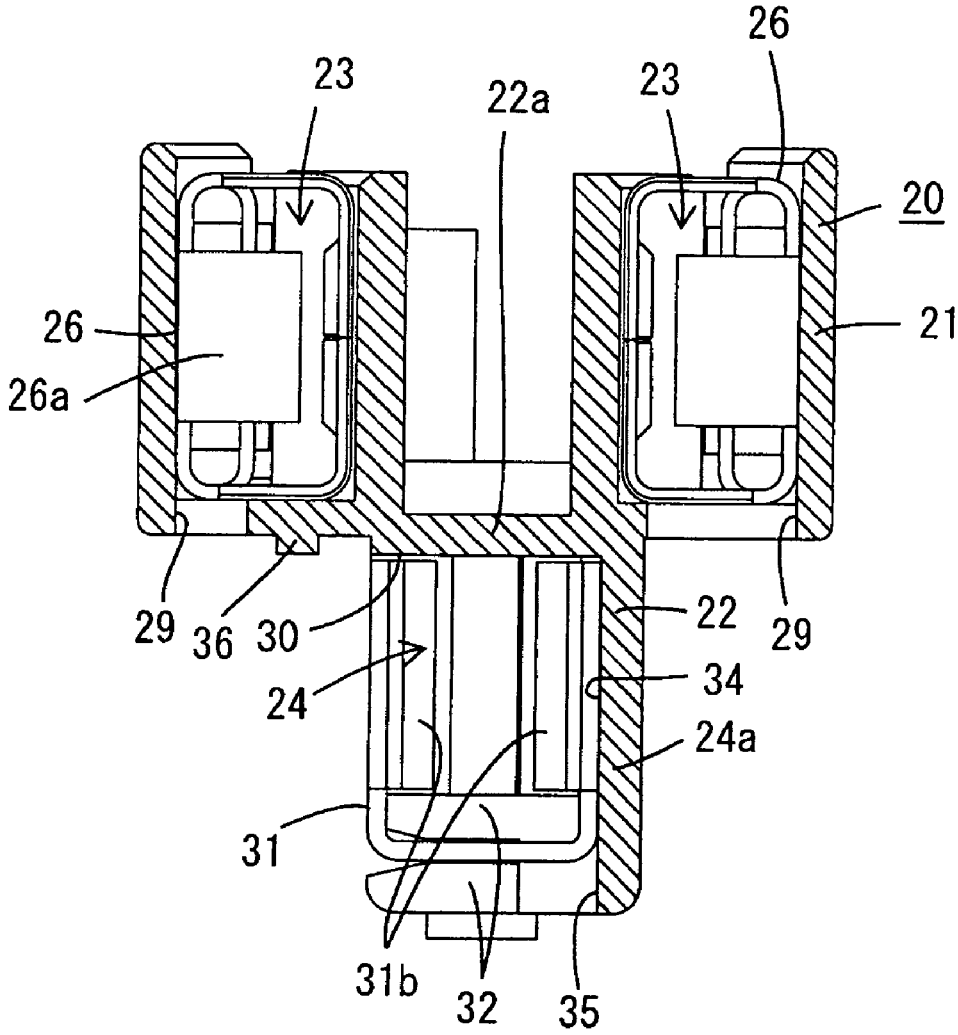
FIG. 8 is a sectional front view of the socket body on which the terminals are mounted.
Figure 9:
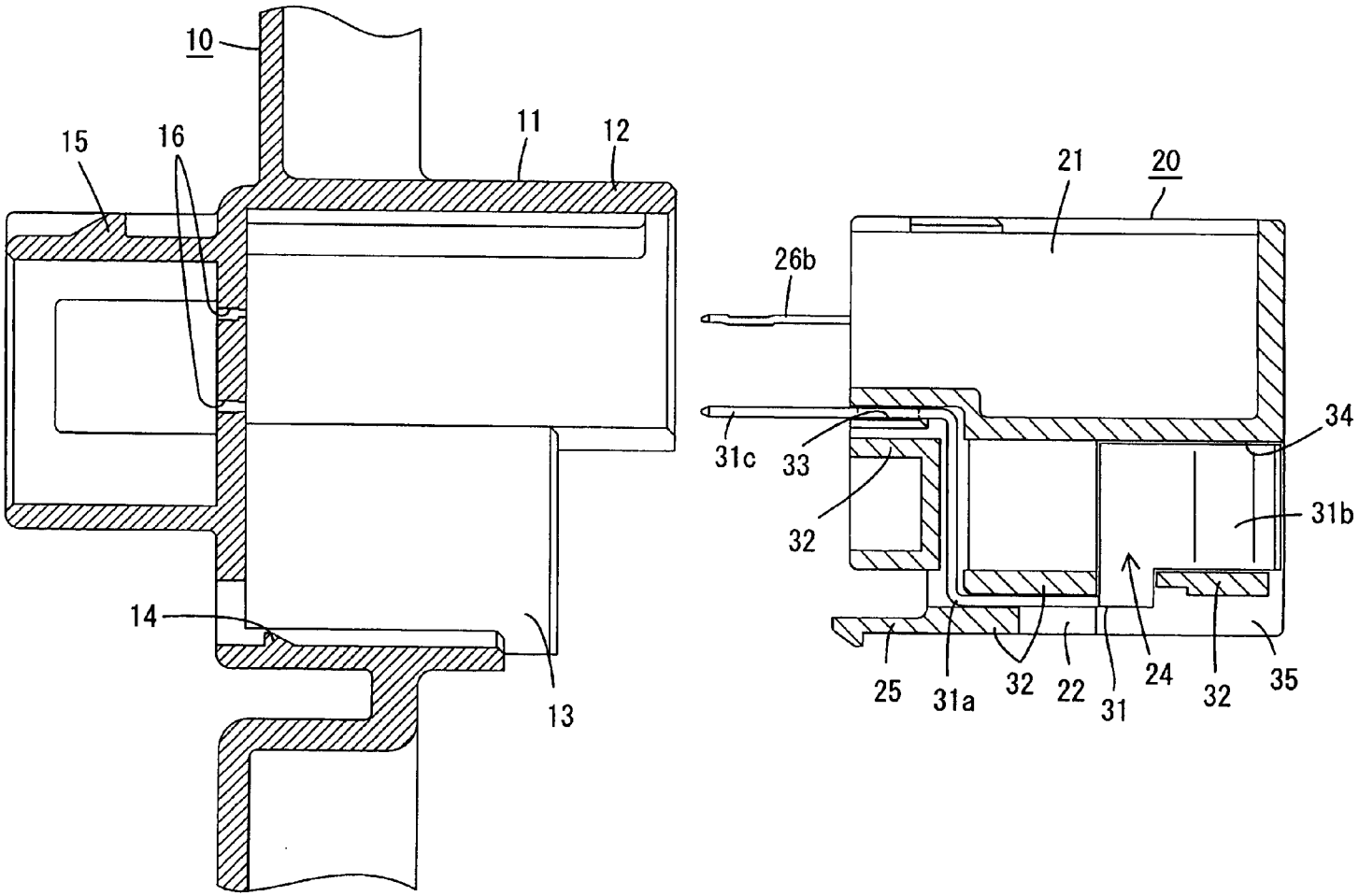
FIG. 9 is a sectional side elevation of the socket body on which the terminals are mounted and a panel.

An outlet socket in accordance with the invention is illustrated in FIGS. 1 through 12. The outlet socket is mounted on a vehicle, such as a pick-up truck, to supply electricity to a vehicle to be towed or to enable use of electric apparatuses outside the vehicle. The outlet socket has a plug socket body 20 in which two plug socket terminals 26 and a ground terminal 31 are mounted. The plug socket body 20 is mounted on a panel 10 fixed to a vehicle body. The left side in FIGS. 4 and 9 is referred to herein as the front and the upper side in FIGS. 1 and 8 is the top.

The panel 10 is made of synthetic resin, and is approximately plate-shaped, as shown in FIGS. 1 and 9. A rear surface of the panel 10 is fixed to the vehicle body (not shown). A cover (not shown) is mounted on a front surface of the panel 10 and can be opened and closed for sealing. A plug socket body accommodation part 11 projects forward from the panel 10, and can receive the plug socket body 20 from the front. The plug socket body accommodation part 11 has a horizontally wide upper accommodation portion 12 and a vertically long lower accommodation portion 13 connected to the upper accommodation portion 12 to define a T-shape in a front view. A holding portion 14 is provided at a rear end of a lower surface in the lower accommodation portion 13 for holding the plug socket body 20 in an accommodated state. An approximately cylindrical connector portion 15 projects rearward from a rear surface of the plug socket body accommodation part 11 and a feeding connector (not shown) of the vehicle body can be fit on the connector portion 15 from the rear. Three terminal insertion holes 16 are formed on a vertical wall between the plug socket body accommodation part 11 and the connector portion 15 for receiving vehicle body side connection portions 26*a*, 31*c* of terminals 16, 31 of the plug socket body 20.

The plug socket body 20 is made of synthetic resin. As shown in FIG. 2, the plug socket body 20 has a horizontally wide upper part 21 and a vertically long lower part 22 that define an approximately T-shape in front view. As shown in FIG. 8, two spaced-apart plug socket terminal accommodation chambers 23 are formed in the upper part 21 and accommodate a pair of plug socket terminals 26. A ground terminal accommodation chamber 24 is formed in the lower part 22 and accommodates a ground terminal 31. The space between the plug socket terminal accommodation chambers 23 is disposed in a central portion of the upper part 21 with respect to the horizontal direction. The ground terminal accommodation chamber 24 is directly below the space, and therefore is offset from both plug socket terminal accommodation chambers 23 in the horizontal direction of the plug socket body 20. As shown in FIG. 9, a holding arm 25 is cantilevered forward from a lower rear end of the lower part 22 of the plug socket body 20. The holding arm 25 has a claw that locks to the holding portion 14 of the panel 10. Thus, the plug socket body 20 can be held by the panel 10.

As shown in FIGS. 4 and 8, an upper wall of each plug socket terminal accommodation chamber 23 is open so that the plug socket terminals 26 can be inserted therein from above. As shown in FIG. 7, the plug socket terminal 26 has a plug side connection portion 26*b* with a contact piece for elastically contacting the inserted plug terminal. A vehicle body side connection portion 26*a* is joined to a rear part of the plug side connection portion 26*b* and projects rearward from the plug socket body 20. As shown in FIGS. 3 and 4, an upwardly open press-fit groove 27 is formed on a rear wall of the plug socket terminal accommodation chamber 23. The press-fit groove 27 holds the plug side connection portion 26*a* when the plug socket terminal 26 is accommodated in the plug socket terminal accommodation chamber 23. As shown in FIG. 2, a forwardly open plug terminal receptacle 28 is formed on a front wall of both plug socket terminal accommodation chambers 23. Thus, a plug terminal (not shown) of a mating plug can be inserted into the plug terminal receptacle 28. As shown in FIG. 8, sidewalls partition the plug socket terminal accommodation chambers 23 from each other. As a result, the plug socket terminals 26 accommodated in the plug socket terminal accommodation chamber 23 are kept in an insulated state.

Figure 5:
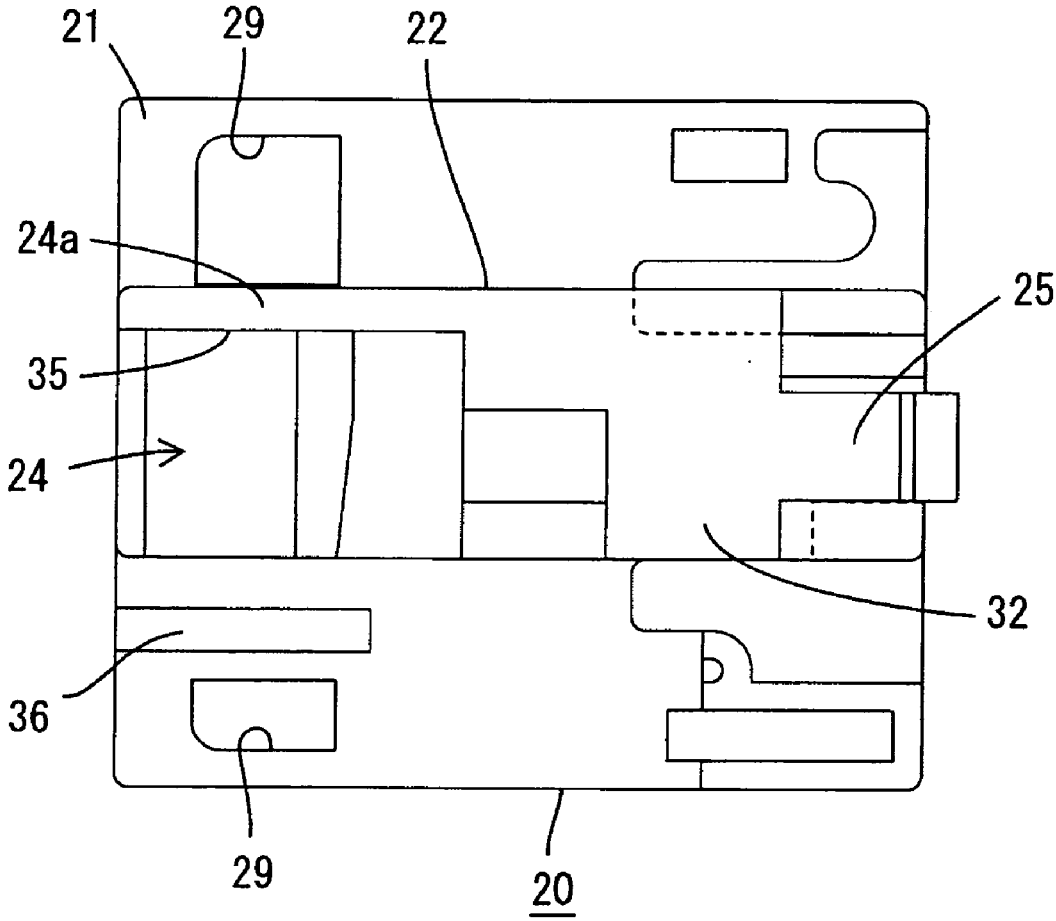
FIG. 5 is a bottom view of the socket body.
Figure 12:
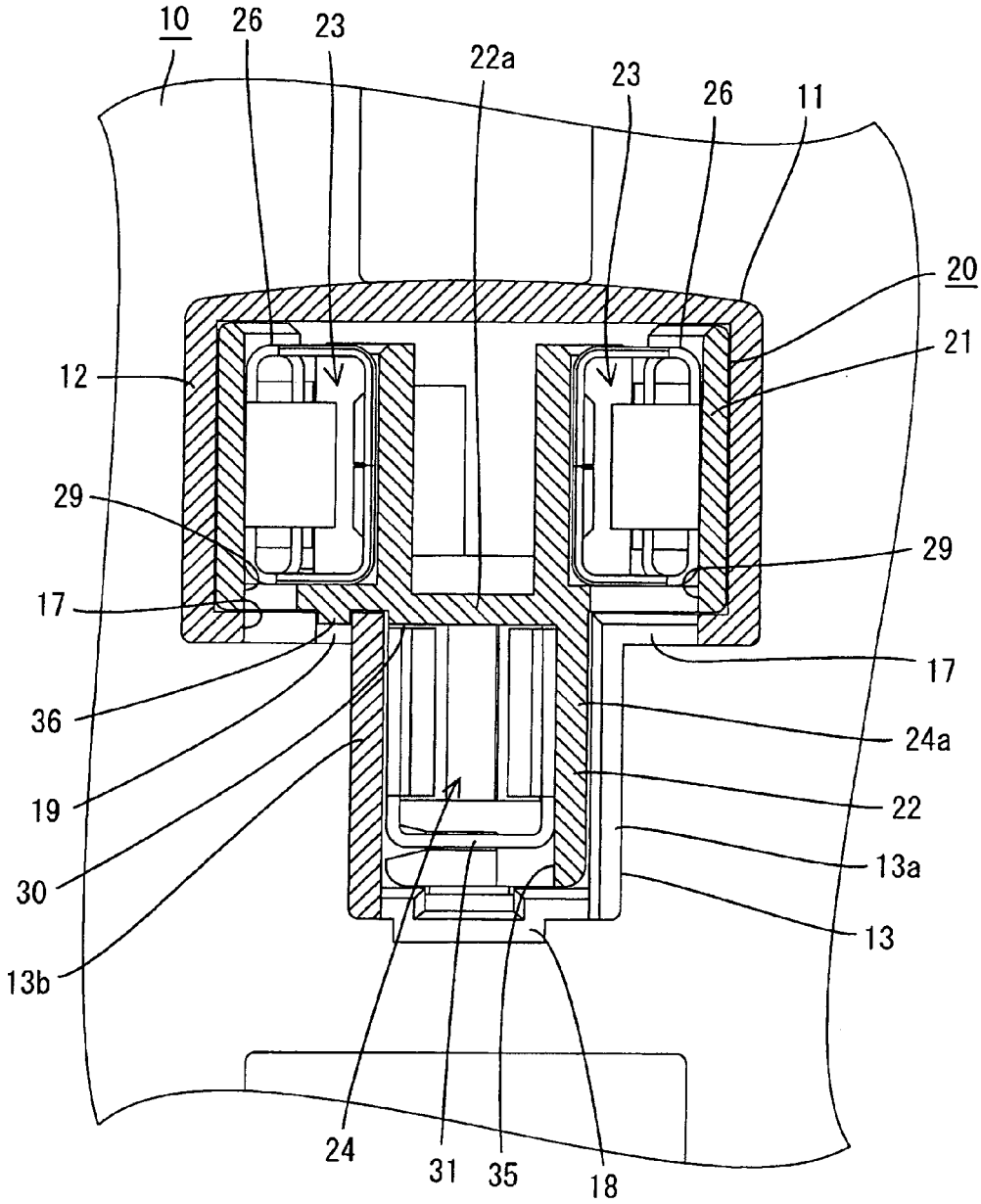
FIG. 12 is a sectional front view showing the state in which the socket body is accommodated inside the plug socket body accommodation part.
Figure 13:
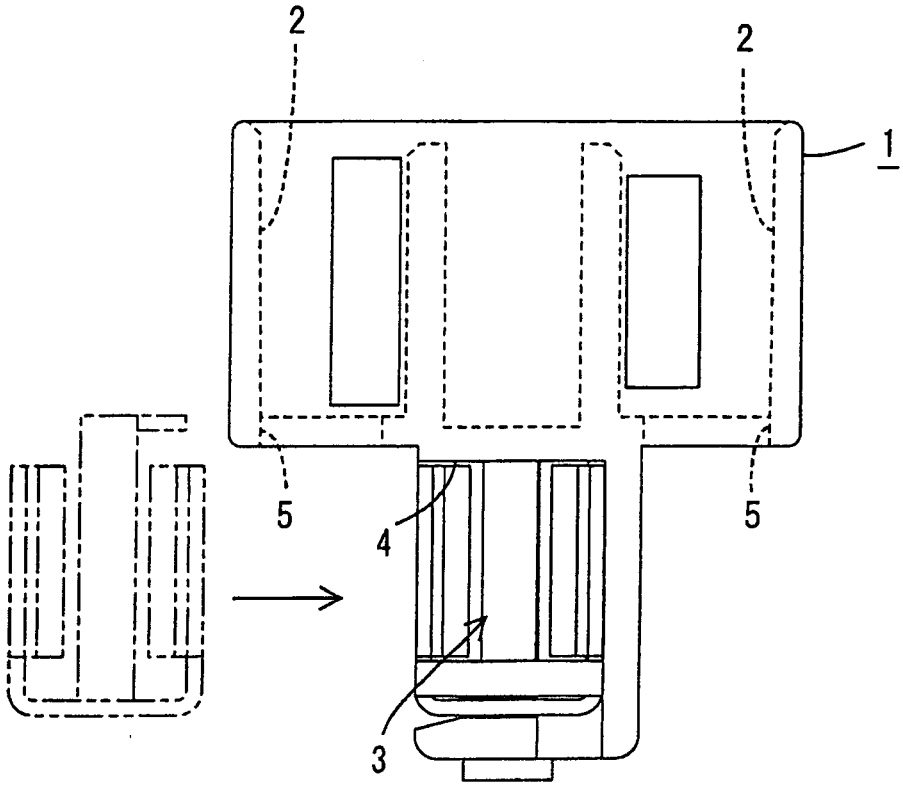
FIG. 13 PRIOR ART
FIG. 13 is a schematic view of a conventional art.

As shown in FIG. 8, downwardly open drain holes 29 are formed on the lower peripheries of the plug socket terminal accommodation chambers 23 for discharging water that has penetrated into the plug socket terminal accommodation chamber 23 from the outside. As shown in FIGS. 4 and 5, the drain holes 29 are approximately quadrilateral in a plan view. Each drain hole 29 is at a front position of the plug socket terminal accommodation chamber 23 and at a side farther from the other plug socket terminal accommodation chamber 23. Thus, the drain hole 29 is rearward from the front end of the upper part 21 of the plug socket body 20 and slightly in from the outer side of the upper part 21. The drain hole 29 at the left side in FIG. 8 is narrower than the drain hole 29 at the right side. As shown in FIG. 12, drains 17 are formed in the plug socket body accommodation part 11 of the panel 10 and communicate with the drain holes 29 when the plug socket body 20 is mounted on the panel 10. Part of a lower wall 12*a* of the upper accommodation portion 12 is removed to form each drain 17. Portions of the right sidewall 13*a* of the lower accommodation portion 13 also are cut away at locations continuous with the lower wall 12*a* to form the drain 17. Thus, water that penetrates into the plug socket terminal accommodation chamber 23 is discharged to the outside through the drain hole 29 and the drain 17.

The sidewall at the left side in FIG. 2 is removed to form an aperture 30 that opens horizontally substantially orthogonal to both the insertion direction of the mating plug and the vertical direction. Thus, the ground terminal 31 is inserted horizontally from the left and into the ground terminal accommodation chamber 24. The ground terminal 31 has a body 31*a* bent in the shape of a crank in the side view shown in FIG. 9. A plug side connection portion 31*b* projects rearward from the body 31*a* and has two contact pieces that sandwich the inserted grounding plug terminal therebetween. A vehicle body side connection portion 31*c* projects forward from the plug socket body 20. Supports 32 project horizontally from a sidewall 24*a* of the ground terminal accommodation chamber 24 for supporting the accommodated ground terminal 31. More specifically, one support 32 supports the plug terminal receptacle 31*b* of the ground terminal 31, two vertical supports 32 sandwich a front horizontal portion of the body 31*a* therebetween, and an approximately U-shaped support 32 supports a vertical portion of the body 31*a* and a rear horizontal portion of the body 31*a*. The vertical portion of the body 31 is pressed from the front by the upper wall of the ground terminal accommodation chamber 24. The rear horizontal portion of the body 31 is pressed from the upper side by the upper wall of the ground terminal accommodation chamber 24. Thus, the ground terminal 31 can be held without being shaken in the front-to-back and vertical directions. As shown in FIG. 3, a press-fit groove 33 is provided at a rear end of the sidewall 24*a* of the ground terminal accommodation chamber 24 and receives a press-fit piece (not shown) that projects from the body 31*a*. As shown in FIGS. 6 and 9, the entire front wall of the ground terminal accommodation chamber 24 is removed to form a plug terminal receptacle 34 and the grounding plug terminal can be inserted from the front.

As shown in FIG. 8, part of the lower wall continuous with the aperture 30 is removed to form a draining aperture 35. The draining aperture 35 discharges water that penetrates into the ground terminal accommodation chamber 24 from outside. As shown in FIG. 12, part of the lower wall of the lower accommodation portion 13 is cut away to form a drain 18 in the plug socket body accommodation part 11 of the panel 10. The drain 18 communicates with the draining aperture 35 when the plug socket body 20 is mounted on the panel 10. Thus, water that penetrates into the ground terminal accommodation chamber 24 is discharged to the outside through the draining aperture 35 and the drain 18.

As shown in FIG. 8, a rib 36 projects down on the peripheral surface of the plug socket body 20 from a position between the aperture 30 of the ground terminal accommodation chamber 24 and the drain hole 29. More specifically, as shown in FIG. 8, the rib 36 is on the lower surface of the left portion of the upper part 21 of the plug socket body 20. That is, the rib 36 is on the side that has the aperture 30. The rib 36 is spaced horizontally from both the aperture 30 and the draining hole 29. The rib 36 is a convexity extending in the front-to-back direction and is almost quadrilateral in a sectional configuration. As shown in FIG. 5, the front end of the rib 36 is substantially flush with the upper part 21 of the plug socket body 20 and is forward from the drain hole 29. The rear end of the rib 36 is rearward from the rear end of the drain hole 29. Water conceivably could creep from the drain hole 29, along the peripheral surface of the plug socket body 20, to the aperture 30 and into the ground terminal accommodation chamber 24. However, the distance of the peripheral surface of the rib 36 increases the creeping distance for the water.

Figure 11:
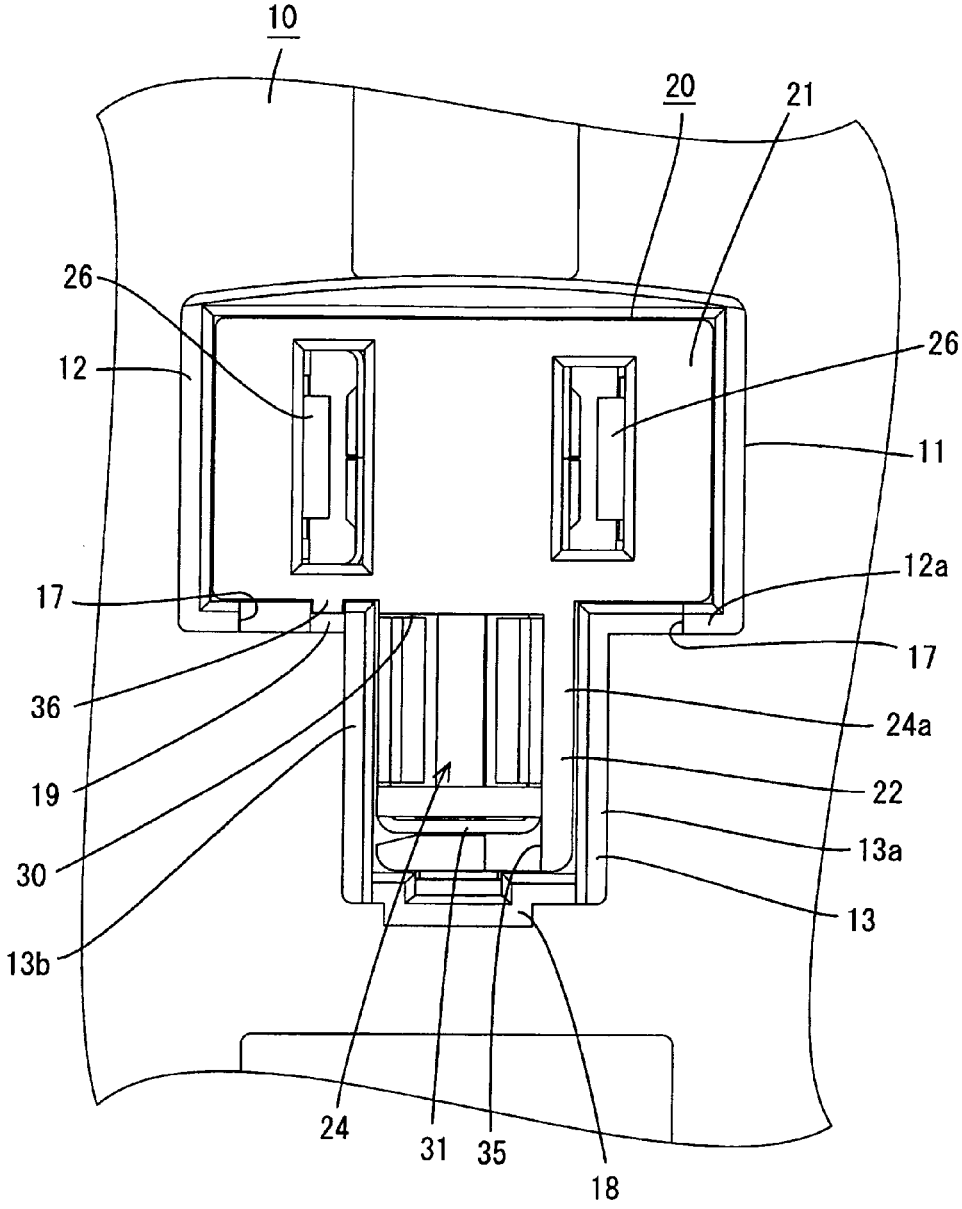
FIG. 11 is a front view showing the state in which the socket body is accommodated inside the plug socket body accommodation part.

As shown in FIGS. 1 and 11, a rib insertion groove 19 is formed inside the plug socket body accommodation part 11 of the panel 10 and adjacent the drain 17. The rib insertion groove 19 can receive the rib 36 when the plug socket body 20 is mounted on the panel 10. The left-hand side (shown in FIG. 1) of the lower accommodation portion 13 of the plug socket body accommodation part 11 has a sidewall 13*b* that plugs the aperture 30 when the plug socket body 20 is mounted on the panel 10. The sidewall 13*b* plugs the aperture 30 entirely in its height and the side surface of the sidewall 13*b* slidably contacts the left side surface of the lower part 22 of the plug socket body 20. When the plug socket body 20 is mounted on the panel 10, the upper end of the side wall 13*b* advances into the gap between the rib 36 and the upper wall 22*a* of the lower part 22 and slidably contacts opposed right surface of the rib 36 and the left surface of the upper wall 22*a*. Thus, the operation of mounting the plug socket body 20 on the panel 10 is guided.

The plug socket terminals 26 and the ground terminal 31 are mounted in the plug socket body 20. The plug socket body 20 then is mounted on the panel 10. More particularly, the plug socket body 20 is inserted into the plug socket body accommodation part 11 from the front in the state shown in FIG. 9. Thus, the peripheral surface of the plug socket body 20 slidably contacts the inner peripheral surface of the plug socket body accommodation part 11. The sidewall 13*b* of the lower accommodation portion 13 advances into the side of the aperture 30, and the rib 36 advances into the rib insertion groove 19. In this process, the upper end of the sidewall 13*b* is sandwiched slidably between the rib 36 and the upper wall 22*a* of the lower part 22 to guide the mounting of the operation of mounting the plug socket body 20 on the panel 10. Thus, the plug socket body 20 will not twist or bend in a direction intersecting the mounting direction. Accordingly, the vehicle body side connection portions 26*a*, 31*c* of the terminals 26, 31 are inserted smoothly into the terminal insertion hole 16, and the vehicle body side connection portions 26*a*, 31*c* are placed in position. During the mounting operation, the claw of the holding arm 25 rides over the holding portion 14 and deforms up.

Figure 10:
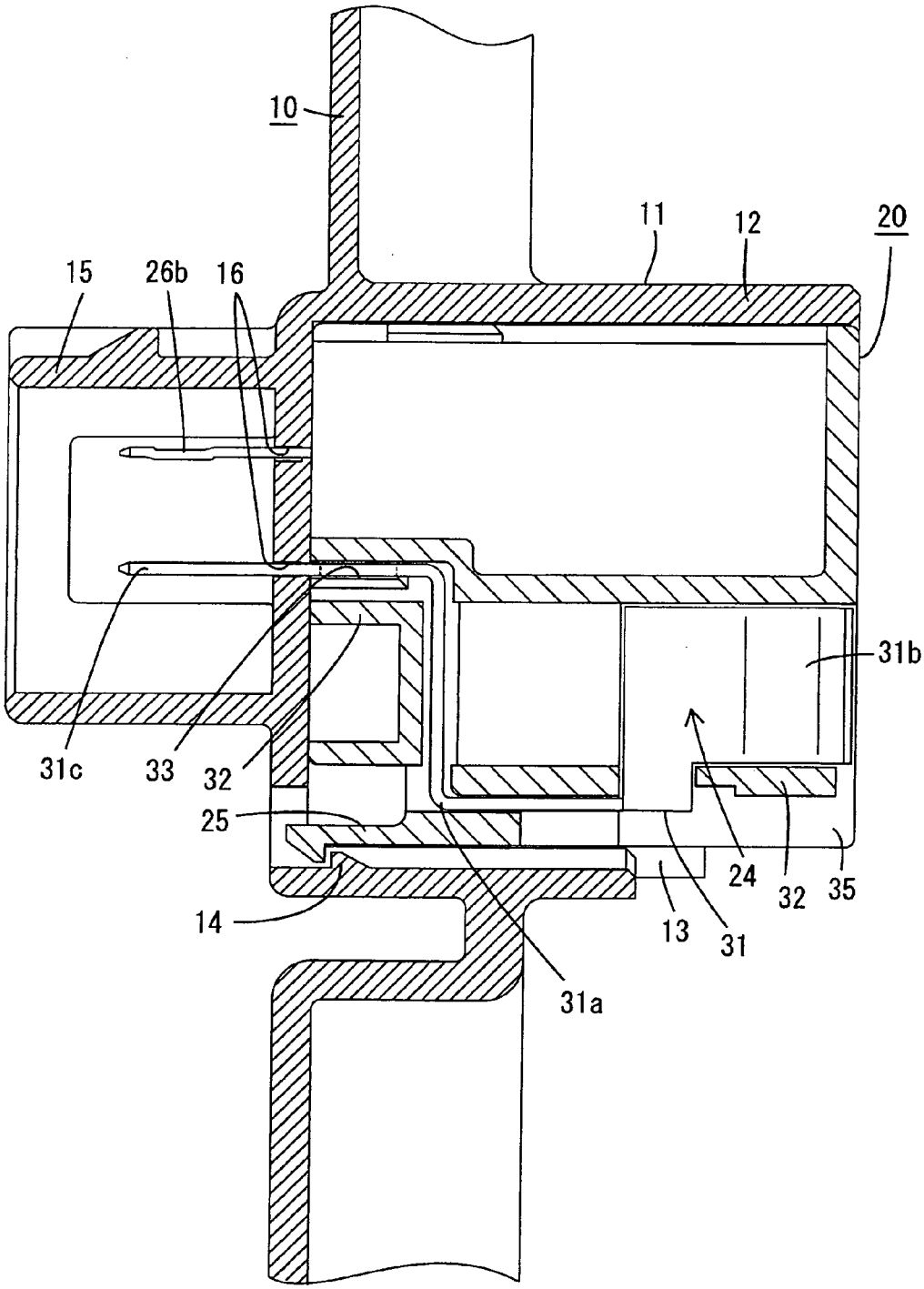
FIG. 10 is a sectional side elevation showing a state in which the socket body is accommodated inside a plug socket body accommodation part.

The holding arm 25 returns resiliently to its original state when the plug socket body 20 is inserted to a predetermined normal depth, as shown in FIG. 10, and the claw is locked to the holding portion 14. Thus, the plug socket body 20 is held on the panel 10. At this time, the vehicle body side connection portions 26*a*, 31*c* of the terminals 26, 31 project into the connector portion 15. In this mounted state, the rib 36 that has entered the rib insertion groove 19 is adjacent the draining portion 17, and the sidewall 13*b* is disposed to plug the aperture 30 entirely in its height. The drain holes 29 and the drains 17 corresponding thereto communicate with each other, and the draining aperture 35 and the drain 18 communicate with each other. The panel 10 and the plug socket body 20 are fixed to the vehicle body with the panel 10 and the plug socket body 20 inclining forward with respect to the vehicle body.

The outlet socket for a vehicle is covered by the cover and sealed from water. However, water may splash when the cover is opened and may penetrate into the plug socket body 20. Water that enters the ground terminal accommodation chamber 24, as shown in FIG. 12, is discharged from the drain aperture 35 to the outside of the ground terminal accommodation chamber 24 and then to the outside of the panel 10 via the drain 18. Water that enters the plug socket terminal accommodation chamber 23 is discharged from the drain hole 29 to the outside of the plug socket terminal accommodation chamber 23 and then to the outside of the panel 10 via the drain 17. The water discharged from the draining hole 29 may not entirely drop through the drain 17, and a part of the water may flow along the peripheral surface of the plug socket body 20. There is a possibility that water that has passed through the left draining hole 29 in FIG. 12 will flow to the aperture 30 and penetrate into the ground terminal accommodation chamber 24. However, the rib 36 is between the drain hole 29 and the aperture 30. Thus, the creeping distance from the drain hole 29 to the ground terminal accommodation chamber 24 is increased by the distance of the peripheral surface of the rib 36. Accordingly water is unlikely to penetrate the ground terminal accommodation chamber 24, and the plug socket terminal 26 and the ground terminal 31 are not likely to be short-circuited. Further, the sidewall 13*b* of the panel 10 plugs the aperture 30, it is possible to introduce the water flowing along the peripheral surface of the plug socket body 20 to the outer surface of the sidewall 13*b*. Thus, it is very difficult for water to penetrate into the ground terminal accommodation chamber 24.

The invention is not limited to the embodiment described above. For example, the following embodiments are included in the scope of the invention. Further, various modifications of the embodiments can be made without departing from the spirit and scope of the invention.

The disposition, configuration, and number of the rib and the draining hole are alterable as desired.

In the above-described embodiment, the rib has been exemplified as the step. However, the step could be a concave portion formed on the peripheral surface of the socket body.

In the above-described embodiment, the rib contacts the sidewall of the panel slidably. However, a gap may be formed between the rib and the sidewall.

In the above-described embodiment, the aperture is plugged with the sidewall of the panel. However, the aperture may not be plugged.

What is claimed is:

1. An outlet socket for a vehicle, comprising a socket body (20) with a plug socket terminal accommodation chamber (23) for accommodating a plug socket terminal (26); and a ground terminal accommodation chamber (24) disposed below said plug socket terminal accommodation chamber (23) and configured for accommodating a ground terminal (31), said ground terminal accommodation chamber (24) having an aperture (30) formed along a direction substantially orthogonal to an insertion direction of a mating plug and substantially orthogonal to a vertical direction, said ground terminal (31) being accommodated through said aperture (30);

a downwardly open drain hole (29) formed through a peripheral wall of said plug socket terminal accommodation chamber (23); and a step (36) formed on a peripheral surface between said drain hole (29) and said aperture (30).

2. The connector of claim 1, wherein said socket body (20) is mounted on a member (10); said member (10) having a wall that plugs said aperture (30) when said socket body (20) is mounted on said member.

3. The connector of claim 2, wherein said wall slidably contacts said step (36) when said socket body (20) is mounted on said member (10) for guiding a mounting operation.

4. The connector of claim 1, wherein the step (36) is a rib (36) projecting down from the peripheral wall.

5. The connector of claim 4, wherein the rib (36) is spaced transversely from the drain hole (29) and the aperture (30).

6. The connector of claim 1, wherein the aperture (30) has a front end and a rear end, the rib (36) having a front end forward of the front end of the aperture (30) and a rear end rearward of the rear end of the aperture (30).

7. An outlet socket body (20) for a vehicle, said socket body (20) having opposite front and rear ends, a top, a bottom and first and second sides, said sock body (20) comprising:

a first plug socket terminal accommodation chamber (23) in proximity to the top and the first side of the socket body (20), a first downwardly open drain hole (29) formed through a bottom wall of said first plug socket terminal accommodation chamber (23);

a second plug socket terminal accommodation chamber (23) in proximity to the top and the second side of the socket body (20), a second downwardly open drain hole (29) formed through a bottom wall of said plug socket terminal accommodation chamber (23);

a ground terminal accommodation chamber (24) disposed below said plug socket terminal accommodation chambers (23) and between the first and second drain holes (29), an aperture (30) extending into the ground terminal accommodation chamber (24) at the first side of the socket body (20); and a rib (36) projecting down from the bottom wall of said first plug socket terminal accommodation chamber (23) between said drain hole (29) and said aperture (30).

8. The socket body (20) of claim 7, wherein the rib (36) is spaced transversely from the drain hole (29) and the aperture (30).

9. The socket body (20) of claim 8, wherein the aperture (30) has a front end and a rear end, the rib (36) having a front end forward of the front end of the aperture (30) and a rear end rearward of the rear end of the aperture (30).

10. The socket body (20) of claim 9, wherein the rib (36) has a rectangular cross-section.

* * * * *